United States Patent [19]

Baxter et al.

[11] Patent Number: 4,917,307

[45] Date of Patent: Apr. 17, 1990

[54] FUEL INJECTOR

[75] Inventors: Randy C. Baxter; John W. Kiracofe,Jr., both of Taylors; Stephen L. Ballenger, Easley, all of S.C.; Paul S. Renowden, Hounslow, England; John Southwood, Watford, England; Richard McGivney, Northolt, England

[73] Assignee: Lucas Industries Public Limited Company, Birmingham, England

[21] Appl. No.: 306,708

[22] Filed: Feb. 6, 1989

[30] Foreign Application Priority Data

Feb. 5, 1988 [GB] United Kingdom ..... 8802597
Oct. 11, 1988 [GB] United Kingdom ..... 8823845

[51] Int. Cl.[4] ..... F02M 51/06
[52] U.S. Cl. ..... 239/585; 239/533.2
[58] Field of Search ..... 239/585, 533.2, 533.3, 239/533.12, 409, 410, 553, 553.3, 553.5

[56] References Cited

U.S. PATENT DOCUMENTS 3,913,845 10/1975 Tsuji ..... 239/533.3
4,280,661 7/1981 Tanasawa et al. ..... 239/409
4,406,404 9/1983 Horino et al. ..... 239/409
4,502,632 3/1985 Hafner et al. ..... 239/585
4,657,189 4/1987 Iwata et al. ..... 239/585
4,771,948 9/1988 Furukawa et al. ..... 239/585
4,773,374 9/1988 Kiuchi et al. ..... 239/533.12

FOREIGN PATENT DOCUMENTS 1282158 12/1961 France ..... 239/585
43962 3/1984 Japan ..... 239/410
2148388 5/1985 United Kingdom ..... 239/585

*Primary Examiner*—Andres Kashnikow
*Assistant Examiner*—Karen B. Merritt
*Attorney, Agent, or Firm*—Fleit, Jacobson, Cohn, Price, Holman & Stern

[57] ABSTRACT

A fuel injector for supplying fuel to an air inlet duct of a spark ignition engine includes a plate valve member which is movable by magnetic forces away from a seating element on a seat member to allow fuel flow through an orifice to form a spray. The fuel spray flowing from the orifice flows into a bore in a tubular outlet and extending from the bore are at least two diverging bores from which two sprays of fuel are emitted, and air is introduced into the space between the orifice and the entrances to the diverging bores.

12 Claims, 5 Drawing Sheets

FUEL INJECTOR

BACKGROUND OF THE INVENTION

This invention relates to a fuel injector for supplying liquid fuel to an air inlet duct of a spark ignition engine, and more particularly to such an injector having a valve seat member on one face of which is formed an annular seating element for engagement by a solenoid actuated plate valve member, an orifice in the seat member through which fuel under pressure flows when the valve member is lifted from the seating element and a tubular outlet through which fuel flows from the orifice to the air inlet duct.

Such injectors are well known in the art and the physical dimensions of the injector have to meet a standard in order to allow interchangeability with injectors which employ different types of valve members. As a result the distance between the orifice and the end of the tubular outlet can be undesirably long when certain spray formations are required. For example, if two sprays are required for use with an engine having two air inlet ducts per cylinder, it is known to form two orifices which are angled to achieve the desired divergence. The extent of divergence is however limited without increasing the diameter of the tubular outlet, by the fact that the spray will impinge upon the wall of the outlet. As an alternative it has been proposed to provide a target at or near the end of the tubular outlet and to direct the fuel as a jet at the target. The target should divide the jet and also break up the jet to form the desired two diverging fuel sprays. In practice however it is found that the sprays are uneven unless the injector is produced to a very high and undesirable, degree of accuracy.

With other injectors it is desired to produce a single busy spray, that is to say a spray which has a large cone angle. The fact that the orifice is spaced from the end of the tubular outlet limits the degree of spread of the spray and if a conical target is used the same problem is encountered as described above namely that the injector must be produced to a very high degree of accuracy in order to form an even spray.

BRIEF SUMMARY OF THE INVENTION

The object of the present invention is to provide an injector of the type specified in a simple and convenient form.

According to the invention, in an injector of the type referred to the orifice is designed to produce a spray within the tubular outlet and at its end remote from the orifice, the outlet defines at least two diverging bores through which the spray passes to form, in the case of an injector having two bores, two diverging sprays.

BRIEF DESCRIPTION OF THE DRAWINGS

Examples of a fuel injector in accordance with the invention will now be described in detail with reference to the accompanying drawings wherein.

DETAILED DESCRIPTION

Figure 1:
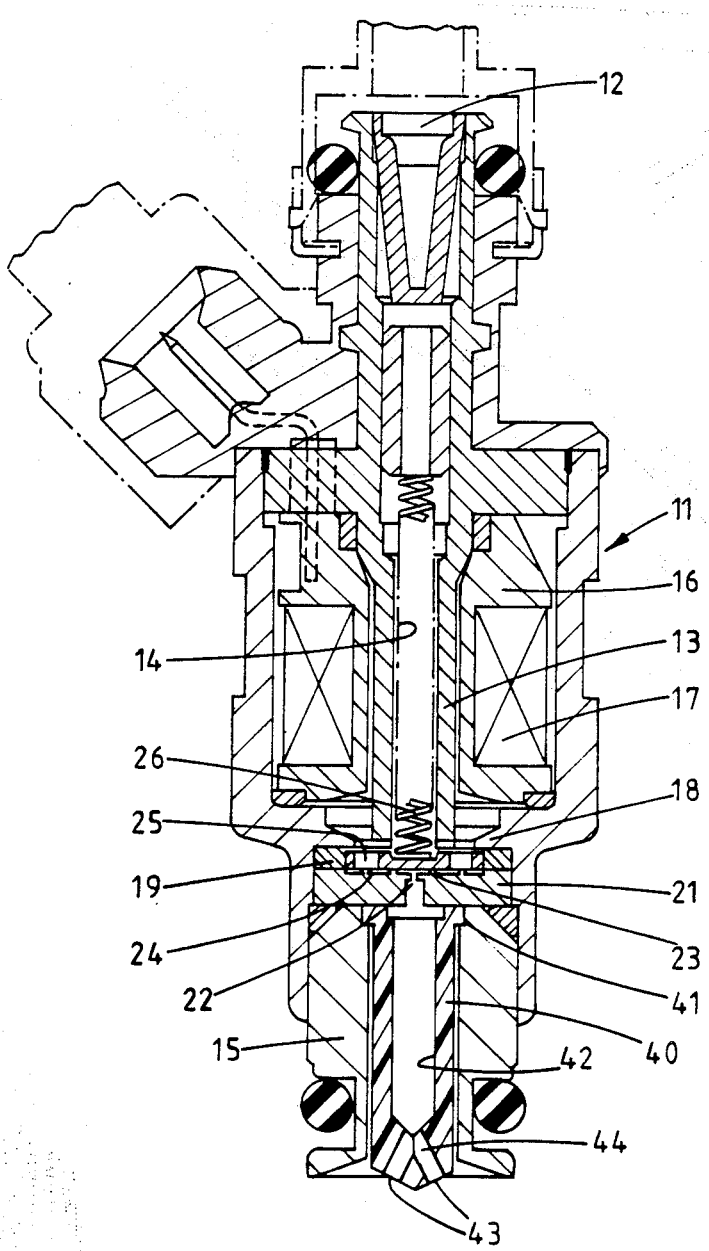
FIG. 1 is a longitudinal cross-sectional view through the injector of the invention.

Referring to FIG. 1 of the drawings the injector comprises a hollow generally cylindrical outer body 11 formed from magnetic material and within which there extends a hollow flanged core member 13 formed from magnetic material. Extending within the core is a passage 14 which extends from an inlet 12 in the body.

Surrounding the core 13 is a former 16 which is formed from synthetic resin material and upon which is wound a solenoid winding 17.

The body 11 defines an integral radially inwardly extending annular shoulder 18 against which there is trapped by means of a non-magnetic valve seat member 21, an annulus 19. The seat member 21 is held in position by means of a tubular outlet member 15 which in use projects into the air inlet manifold of the engine. The seat member 21 is in the form of a disc the diameter of which is equal to the internal diameter of the body 11 and the disc has a central orifice 22 formed therein. The orifice is surrounded by an inner annular seat element 23 which is engageable by a plate valve member 24 biased by a spring 26 into contact with the seat element and located within the annulus 19. The plate valve member has a plurality of openings 25 and it is formed from magnetic material so that when the winding 17 is energized the flange and core member assume opposite magnetic polarity and the valve member is attracted away from the seat element against the action of the spring. In this situation fuel can flow through the passage 14 and the openings 25 to the central orifice 22. The movement of the valve member towards the shoulder is limited by a non-magnetic shim (not shown).

Mounted within the outlet member 15 is a non-magnetic tubular outlet 40 having a flange 41 at its end adjacent seat member 21, the flange located in a complementary recess formed in the outlet member 15. The tubular outlet 40 defines a chamber 24 which is closed at its end remote from the seat member except for a pair of divergent bores 43 which extend from the chamber 42. The bores 43 are constructed so that there is defined at the junction thereof a sharp edge 44.

The orifice 22 can be regarded as being formed in a thin plate and its is designed so that good atomization of the fuel flowing therethrough is obtained while at the same time it is relatively insensitive to variations in the temperature to which the injector is subjected during use. When in use the valve member is lifted from seat element 23, fuel flows through the orifice to form a spray within the chamber 42 and as the spray progresses along the chamber it becomes evenly distributed and exits through the bores 43 to form two diverging sprays. In a particular application the angle between the two bores 43 is chosen so that the resulting sprays are directed into a pair of air inlet ducts of a cylinder of a spark ignition engine.

Figure 3:
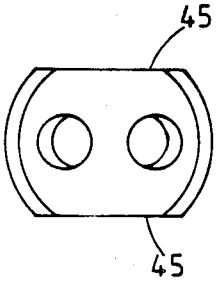
FIG. 3 is a bottom plan view of FIG. 2.
Figure 9:
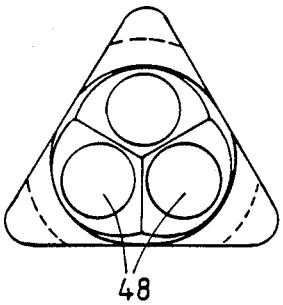
FIGS. 9 and 10 are top plan views corresponding to FIGS. 6 and 7.
Figure 10:
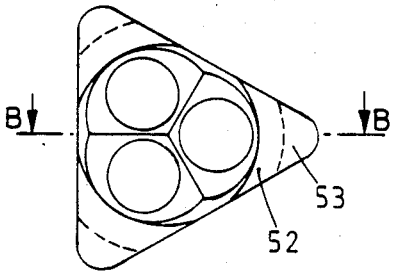
Figure 6:
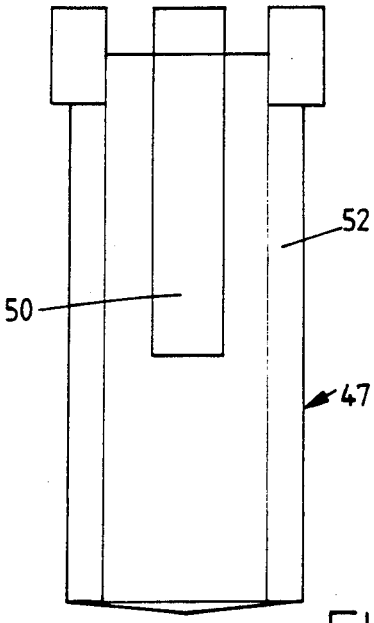
FIG. 6 is a side elevational view of the outer insert member of a two part insert for incorporation in the injector shown in FIG. 1.
Figure 7:
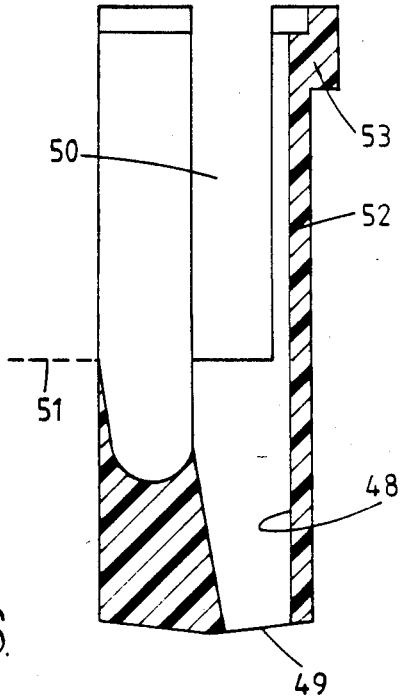
FIG. 7 is a cross-sectional side elevation view of the outer insert member shown in FIG. 6 taken on the line BB of FIG. 10.
Figure 8:
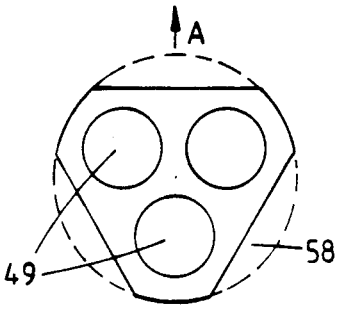
FIG. 8 is an end view in the direction of the arrow A of FIG. 6.
Figure 13:
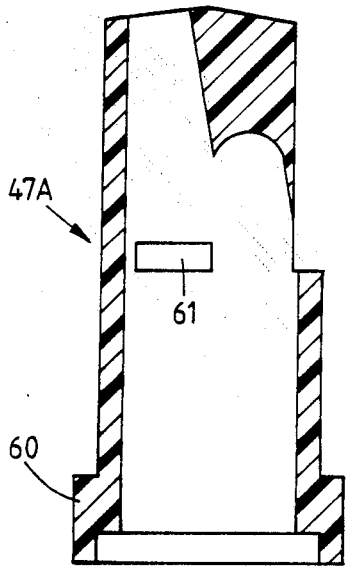
FIG. 13 is a longitudinal cross-sectional view of a modified form of the outer insert member taken on the line YY of FIG. 15.

An important aspect of the invention is the provision of flats 45 on the outer side of the tubular outlet 40 as shown in FIG. 3. The flats communicate with a transverse recess 46 formed in the end of the flange of the tubular outlet adjacent the seat member 21. However, the transverse recess may be replaced by rectangular openings 61 such as are illustrated in FIG. 13.

In use when the flow of current in the winding 17 ceases and the valve member returns to the seat element, fuel spray which is already within the chamber 42 continues to move along the chamber and through the bores 43. In so doing air is drawn into the chamber along the flats 45 and the recess 46. In more conventional injectors of this type the fuel spray tends to be halted when the valve member closes onto the seat element 23 and then tends to dribble from the injector outlet thereby resulting in poor combustion of the fuel.

Figure 4:
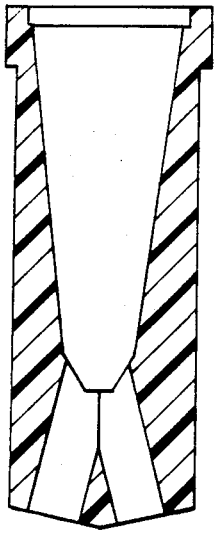
FIGS. 4 and 5 are views similar to FIG. 2 which show alternative embodiments of the part.
Figure 2:
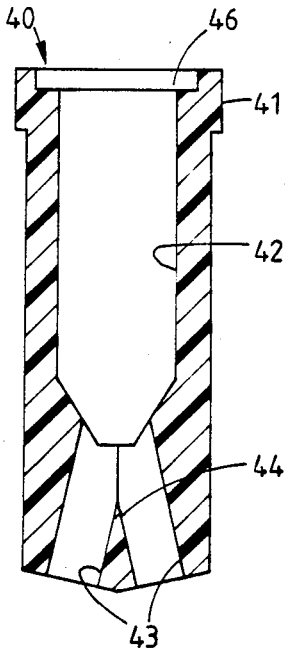
FIG. 2 is a cross-sectional view on an enlarged scale of part of the injector shown in FIG. 1.
Figure 5:
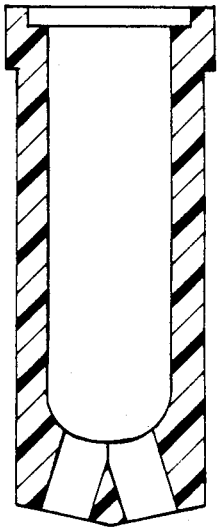

FIGS. 4 and 5 show alternative configurations for the chamber 42, the chamber in the example of FIG. 4 being tapered towards the bores 43 and that in FIG. 5 having a rounded end adjacent the bores 43.

If it is desired to produce a single bushy spray then three or more bores 43 can be provided, the bores being equiangularly disposed about the axis of the tubular outlet 40. It is convenient with this construction to provide the same number of flats 45 as there are bores.

In a modification (not shown) the flange 41 can be omitted and the tubular outlet 40 secured within the tubular outlet member 15 by its having an interference fit or by means of welding or adhesive. The tubular outlet 40 may be formed from a plastics material.

The tubular outlet 40 and the outlet member 15 could be formed as a single item with the flats 45 defined by axial passages extending the length of the combined unit.

The tubular outlet 40 can be constructed as a two part insert both parts of which are molded from synthetic resin material. The insert comprises a hollow outer insert member 47 seen in FIGS. 6–10, which in the example is of triangular section. At its end remote from the seat member 21 the outer insert member has an integral end wall in which there are formed three diverging bores 48 each of which defines an outlet 49. The bores are positioned at the apices of the outer insert member and the side walls of the the outer insert member are formed with rectangular cutouts 50 which extend to a level 51 from the end of the member adjacent the seat member 21. The remaining portions of the insert member are hereinafter termed legs 52 and each leg at its free end is provided on its outer surface, with an axial projection 53 having a rounded outer peripheral surface. The projections locate against a step formed in the bore in the outlet member 15.

Figure 12:
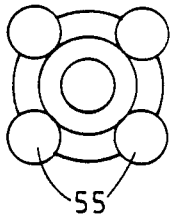
FIG. 12 is top plan view of the inner insert member of FIG. 11.
Figure 11:
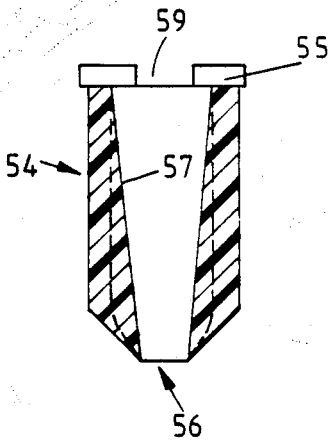
FIG. 11 is a cross-sectional view of the inner insert member.

Positioned within the portion of the outer insert member defined by the legs 52 is an inner insert member 54 seen in FIGS. 11 and 12, which is of tubular form. The end of the inner insert member adjacent the seat member 21 is provided with four outwardly and axially extending projections 55 which when the inner and outer insert members are assembled together locate against the ends of the legs 52. The fact that there are three legs 52 and four projections 55 means that whatever the relative angular position of the insert members there will always be adequate location.

The other end of the inner insert member is cut off at an angle so as to form a sharp edge which defines a central opening 56. The bore 57 can be tapered as shown in solid outline or it can be substantially uniform in diameter as shown in dotted outline with a tapered section at the end leading to the central opening 56. In the former case a jet of fuel will issue through the opening 56 and three jets of fuel will issue through the openings 49. In the latter case the fuel leaving the opening 56 will be in the form of a spray so that three sprays of fuel will issue through the openings 49.

The length of the inner insert member is such that the inner end thereof lies below the level 51 but the length of the right cylindrical portion of the outer wall thereof is such that the inner ends of the cutouts 50 form rectangular openings which communicate with channels 58 (FIG. 8) defined between the wall of the bore in the outlet member 15 and the flat faces of the outer insert member. The fuel which flows through the opening 56 induces a flow of air along the channels, and through the rectangular openings. The flow of air will entrain any droplets of fuel which may collect on the end of the outer insert member surrounding the openings 49 and on the end of the outlet member 15 which as will be seen in FIG. 1, is partly recessed.

An air flow is also induced through the inner portions of the channels 58 by the flow of fuel through the orifice 22. The air flow taking place through openings to the bore 57 from the channels through openings 59, being defined between the projections 55.

In an alternative arrangement the openings 59 are omitted by reason of the fact that the projections 53 are flush with the end of the inner insert member. In this case the inner insert member 54 is provided with three drillings (not shown) which extend from the channels 58 respectively into the bore 57, the drillings being angled in the direction of fuel flow.

Where the insert is designed to produce three sprays of fuel the end portion of the outer insert member can be chamfered, the chamfer breaking into the bores 48, to provide clearance for the sprays.

It will be understood that the outer insert member may be provided with two bores 48 therefore defining two outlets. In this case two channels only are defined between the bore in the outlet member 15 and the outer insert member.

Figure 15:
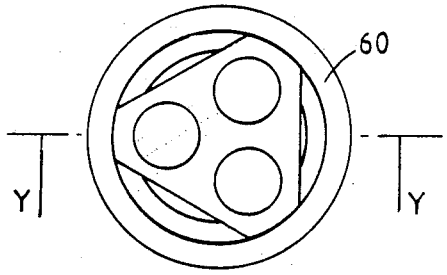
FIGS. 14 and 15 are bottom and top plan views respectively of the outer insert member of FIG. 13.
Figure 14:
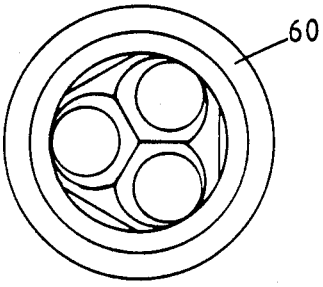

Turning now to FIGS. 13, 14 and 15 there is shown a modification to the outer insert member 47A. In this case the cutouts 50 are eliminated and only the portion of the insert member 47A which in the assembled nozzle is furthest from the seat member 21 is of triangular section, the remaining portion of the insert member being of cylindrical section with an annular rim 60.

Figure 16:
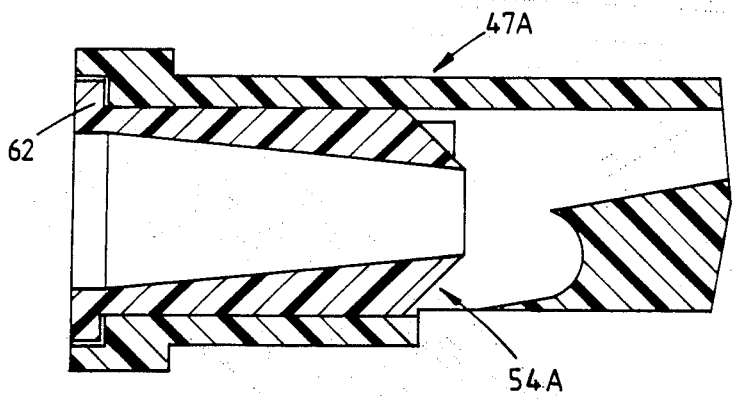
FIG. 16 is a longitudinal cross-sectional view showing the outer insert member of FIGS. 13, 14 and 15 with an inner insert member assembled therein.

Channels corresponding to the channels 58 are defined between the sides of the triangular portion of the outer insert member 47A and the wall of the outlet member 15 and these channels which extend only so far as the cylindrical portion of the insert member, communicate with generally rectangular openings 61 which extend through the side walls of the insert member. The openings 61 are located at substantially the same positions as the inner ends of the cutouts 50 in the example shown in FIG. 6 and air can pass through the openings during the use of the nozzle. FIG. 16 shows in section, the outer insert member 47A with an inner insert member 54A located in position. The inner insert member 54A corresponds to the inner insert member 54 except that the projections 55 are replaced by a continuous annular rim 62.

Figure 17:
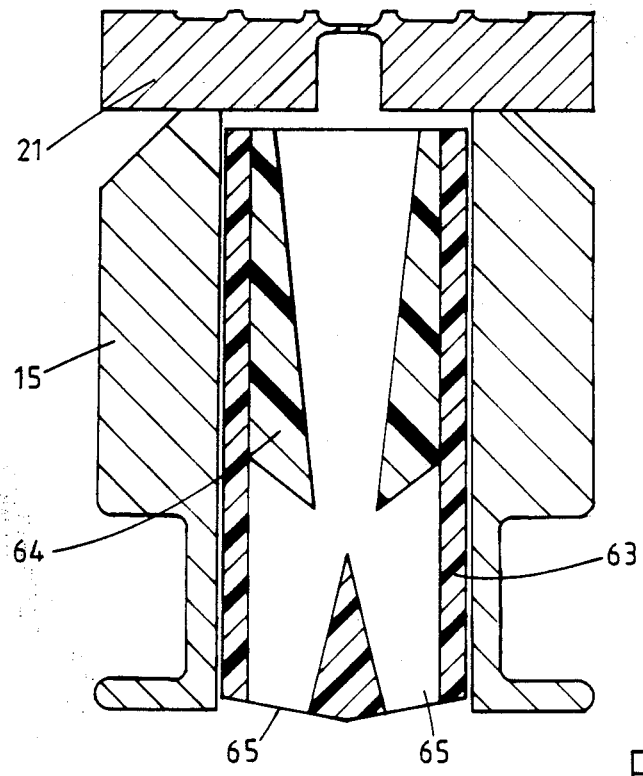
FIG. 17 is a longitudinal cross-sectional view of a modified two part insert shown located in an outlet member of the nozzle.

FIG. 17 shows a modified form of the two part insert. The outer insert member 63 is secured by adhesive within the outlet member 15 as previously suggested, but in addition, the inner insert member 64 is secured by adhesive or in any other convenient manner, within the outer insert member. FIG. 17 shows a two part insert which has two outlets 65 and a pair of flats not shown, are provided on the external surface of the outer insert member 63 to allow air flow into the bore in the inner insert member. Both the insert members 63 and 64 are spaced from the seat member 21 to allow the air flow.

We claim:

1. A fuel injector for supplying liquid fuel to an air inlet duct of a spark ignition engine comprising:

a valve seat member having at least one face thereon;

an annular seating element formed on said at least one face of said valve seat member;

a solenoid actuated plate valve member member engageable with said annular seating member;

an orifice in said seat member for the flow of fuel under pressure therethrough when said valve member is lifted from said seating element;

a tubular outlet for the flow of fuel therethrough from said orifice to the air inlet duct, said orifice producing a fuel spray within said tubular outlet;

an outlet end on said tubular outlet remote from said orifice; and at least two diverging bores at said outlet end for emitting at least two diverging fuel sprays therethrough.

2. A fuel injector as claimed in claim 1 and further comprising:

means for admitting air into said tubular outlet from a position removed from but adjacent to said diverging bores.

3. A fuel injector as claimed in claim 1 and further comprising:

openings in said tubular outlet; and means communicating said openings with the air inlet duct adjacent said outlet end of the injector.

4. A fuel injector for supplying liquid fuel to an air inlet duct of a spark ignition engine comprising:

a valve seat member having at least one face thereon;

an annular seating element formed on said at least one face of said valve seat member;

a solenoid actuated plate valve member engageable with said annular seating member;

an orifice in said seat member for the flow of fuel under pressure therethrough when said valve member is lifted from said seating element;

a tubular outlet for the flow of fuel therethrough from said orifice to the air inlet duct, said orifice producing a fuel spray within said tubular outlet;

an outlet end on said tubular outlet remote from said orifice;

at least two diverging bores at said outlet end for emitting at least two diverging fuel sprays therethrough; and said tubular outlet comprising an outer tubular insert member and an inner tubular insert member disposed within said outer tubular insert member, disposed within said outer insert member, said diverging bores being defined in said outer insert member, a further bore in said inner insert member for receiving fuel spray from said orifice, and an outlet on said inner insert member for directing fuel spray to entrances of said diverging bores.

5. A fuel injector as claimed in claim 4 and further comprising:

a space between said outlet on said inner insert member and the entrances of said diverging bores; and slots in the wall of said outer tubular insert member extending from the end thereof adjacent said seat member, said slots being closed over substantially the entire length thereof by said inner insert member so that openings are provided for the flow of air into said space.

6. A fuel injector as claimed in claim 4 wherein:

channels are provided on said inner insert member at the end thereof adjacent said seat member so that further air can be admitted into said further bore in said inner insert member adjacent said orifice.

7. A fuel injector as claimed in claim 6 wherein:

a tubular outlet member is provided, said outer tubular insert being disposed in said tubular outlet member; and further channels are provided between the outer surface of said outer insert member and the inner surface of said tubular outlet member.

8. A fuel injector as claimed in claim 4 and further comprising:

a space between said outlet on said inner insert member and the entrances of said diverging bores; and a plurality of openings through the wall of said outer insert member positioned to allow a flow of air into said space.

9. A fuel injector as claimed in claim 4 wherein:

said inner inset member has an end provided with a series of projections adjacent said seat member, said outer insert member being shaped to engage with and locate said projections;

a tubular outlet member is provided; and said outer insert member has projections thereon for securing said outer insert member within said tubular outlet member.

10. A fuel injector as claimed in claim 4 wherein:

a tubular outlet member is provided;

said inner insert member is secured within said outer insert member; and said outer insert member is secured within said tubular outlet member.

11. A fuel injector as claimed in claim 4 wherein:

said inner insert member has an end provided with a peripheral flange adjacent said seat member, said outer insert member being shaped to engage with and locate said flange;

a tubular outlet member is provided; and flange means is provided on said outer insert member for securing said outer insert member within said tubular outlet member.

12. A fuel injector for supplying liquid fuel to an air inlet duct of a spark ignition engine comprising:

a valve seat member having at least one face thereon;

an annular seating element formed on said at least one face of said valve seat member;

a solenoid actuated plate valve member engageable with said annular seating member;

an orifice in said seat member for the flow of fuel under pressure therethrough when said valve member is lifted from said seating element;

a tubular outlet member;

a tubular outlet mounted within said tubular outlet member for the flow of fuel therethrough from said orifice to the air inlet duct, said orifice producing a fuel spray within said tubular outlet;

an outlet end on said tubular outlet remote from said orifice;

at least two diverging bores at said outlet end for emitting at least two diverging fuel sprays therethrough;

flats on the exterior surface of said tubular outlet;

channels between said flats and the internal surface of said tubular outlet member; and transverse recesses at the end of said tubular outlet adjacent said seat member communicating with said flats to facilitate air flow from the air inlet duct.

* * * * *